United States Patent [19]

Goettert et al.

[11] 4,288,536

[45] Sep. 8, 1981

[54] PHOTOTHERMOGRAPHIC STABILIZERS

[75] Inventors: Edward J. Goettert; Gustav Gutman, both of Lake Elmo, Minn.

[73] Assignee: Minnesota Mining and Manufacturing Company, St. Paul, Minn.

[21] Appl. No.: 45,632

[22] Filed: Jun. 5, 1979

[51] Int. Cl.[3] ..... G03C 1/02

[52] U.S. Cl. ..... 430/619; 430/617; 430/353

[58] Field of Search ..... 430/617, 618, 619, 620, 430/353

[56] References Cited

U.S. PATENT DOCUMENTS

| | | | |
|---|---|---|---|
| 3,220,846 | 11/1965 | Tinker | 96/114.1 |
| 3,515,559 | 6/1970 | Druker et al. | 96/114.1 |
| 3,679,422 | 7/1972 | de Mauriac | 96/114.1 |
| 3,707,377 | 12/1972 | Tiers | 96/114.1 |
| 3,839,048 | 10/1974 | Poot | 96/114.1 |
| 3,935,012 | 1/1976 | Eian | 96/114.1 |
| 3,980,482 | 4/1976 | Reece | 96/114.1 |
| 4,030,930 | 6/1977 | Sashihara | 96/114.1 |
| 4,108,665 | 8/1978 | Gutman | 96/114.1 |
| 4,120,728 | 10/1978 | Ikenoue | 96/114.1 |
| 4,168,169 | 9/1979 | Humphlett | 96/114.1 |
| 4,212,937 | 7/1980 | Akashi et al. | 430/620 |

FOREIGN PATENT DOCUMENTS

| | | | |
|---|---|---|---|
| 2363586 | 6/1974 | Fed. Rep. of Germany | 96/114.1 |
| 2446892 | 4/1975 | Fed. Rep. of Germany | 96/114.1 |

*Primary Examiner*—Mary F. Downey

*Attorney, Agent, or Firm*—Cruzan Alexander; Donald M. Sell; Mark A. Litman

[57] ABSTRACT

The addition of certain classes of aromatic nitrogen containing compounds to photothermographic emulsions stabilizes the background density of the imaged film and/or increases the speed of the emulsion.

10 Claims, No Drawings

PHOTOTHERMOGRAPHIC STABILIZERS

BACKGROUND OF THE INVENTION

Photothermographic elements have been commercially available for a number of years and are found in various technological formats. The most successful photothermographic systems are those based on the technology disclosed in U.S. Pat. No. 3,457,075. Here it was taught to intimately associate light insensitive organic silver salts with light sensitive silver halide grains in the presence of a developer for silver ions. This intimate association was referred to as having the two silver components in catalytic proximity. This condition of catalytic proximity was first achieved by directly halidizing light insensitive silver organic salts, although it has been subsequently found that catalytic proximity could be achieved by precipitating the organic silver salt in the presence of preformed or coprecipitated silver halide (e.g., U.S. Pat. No. 3,839,049). Three essential ingredients, organic silver salt, silver halide, and developer, were combined in a binder to form a light sensitive, thermally developable imaging element. Subsequent work (e.g., U.S. Patent Application Ser. No. 666,350 filed Mar. 12, 1976) has found that the image silver source material (a material which can be reduced to silver), previously limited to organic silver salts, may also include complexes of any silver salt where the coordinating compound has a gross stability constant of between 4.50 and 10.00 with silver ion. The silver salt may be organic or inorganic with such a system.

A significant limitation in the general utility of these photothermographic systems which use silver halides as the sensitive component has been their lack of speed (i.e., the requirement of relatively high energy for image exposure) and image stability after development.

SUMMARY OF THE INVENTION

It has been found that the addition of a certain class of aromatic, nitrogen containing heterocyclic compounds to silver halide sensitized, silver image-forming photothermographic systems improves the speed of the system and/or its image stability. These nitrogen containing heterocyclic compounds include, but are not limited to, pyridine and its derivatives, pyrazine and its derivatives, pyridazine and its derivatives, and pyrimidine and its derivatives.

DETAILED DESCRIPTION OF THE INVENTION

The present invention relates to silver halide containing silver image forming photothermographic systems. These systems are defined as light sensitive systems having photographic silver halide in catalytic proximity to a silver source material selected from organic silver salts and complexes of silver salts. The silver source materials are preferably selected from silver salts of long chain fatty acids (i.e., $C_{12}$ to $C_{30}$ carboxylic or polycarboxylic acids, preferably $C_{16}$ to $C_{26}$ carboxylic acids) or complexes of silver salts wherein the coordinating compound has a gross stability constant of between 4.50 and 10.0 for silver ion. Either a pure single acid salt or salt from a mixture of acids may be used. These systems also contain a reducing agent for silver ion, preferably a photographic developer or hindered phenol developer as is known in the art. These ingredients of the photothermographic element are given structural integrity by inclusion in a binder material, as is known in the art. For example, binders such as gelatin, polyvinyl butyral, polyvinyl acetate, cellulose acetate, cellulose acetate butyrate or propionate, polyester, polyamide, polyurethane, polycarbonate, polyolefin, etc., may be used. The binder is, of course, most useful when it is transparent or at least translucent.

The stabilizing or speed increasing additives of the present invention may be represented by the following formulae:

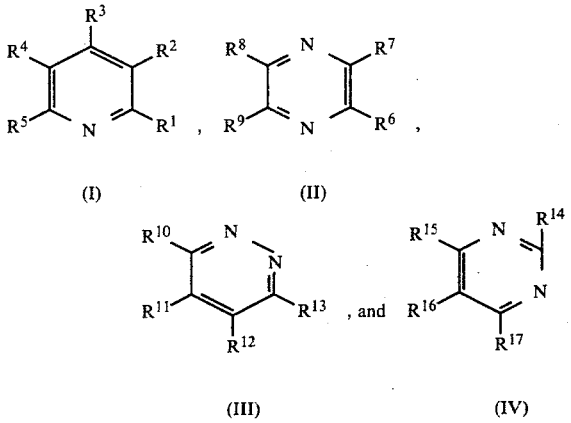

(I) (II) (III) (IV)

wherein $R^1$, $R^3$, $R^5$, $R^6$, $R^7$, $R^8$, $R^9$, $R^{10}$, $R^{13}$, $R^{14}$, $R^{15}$ and $R^{17}$ are selected from H, alkyl (of 1 to 20 carbon atoms), alkoxy (of 1 to 12 carbon atoms), cyano, primary, secondary, and tertiary amides (e.g., $$-\underset{\underset{O}{\|}}{C}NR_{16}R_{19}$$

wherein $R^{18}$ and $R^{19}$ are selected from H, alkyl groups (of 1 to 12 carbon atoms), and phenyl groups) and carboalkoxy (i.e., $$ROC-\underset{\underset{O}{\|}}{}$$

where R is an alkyl group of 1 to 12 carbon atoms); wherein $R^3$, $R^{11}$, $R^{12}$ and $R^{16}$ may also be acyl (of 1 to 12 carbon atoms including aromatic moieties therein), wherein $R^2$, $R^4$, $R^{12}$, and $R^{16}$ are selected from H, alkyl (of 1 to 20 carbon atoms), alkoxy (of 1 to 12 carbon atoms, carboalkoxy (i.e., $$ROC-\underset{\underset{O}{\|}}{}$$

where R is an alkyl group of 1 to 12 carbon atoms), acyl (of 1 to 12 carbon atoms including aromatic moietites therein), cyano, and hydroxy, and wherein $R^1$ and $R^2$, $R^2$ and $R^3$, $R^6$ and $R^7$, $R^{10}$ and $R^{11}$, $R^{15}$ and $R^{16}$, and $R^{16}$ and $R^{17}$ may be the carbon and hydrogen atoms necessary to form a fused benzene ring sharing a common ethylene group with the heterocyclic ring. Less preferred $R^1$–$R^{17}$ groups include amino, alkylamino (1 to 12 carbon atoms), and dialkylamino groups (of 1 to 12 carbon atoms per alkyl) because of a tendency for higher fog.

It is preferred that the substituent R groups have no more than five carbon atoms each (i.e., 1 to 5 carbon atoms) and that any fused or cojoined benzene rings formed by adjacent R groups, as described above, have themselves no more than two R group substituents other than H selected from the group of OH, alkyl, alkoxy, carboalkoxy and acetyl, again with no more than 12 carbon atoms per substituent group and preferably no more than 5 carbon atoms per group. It is preferred that no substituents should be present on the heterocyclic additives of the present invention which constitute or contribute photographically or photothermographically interfering groups such as, for example, mercapto, and possibly carboxylic acid groups. Simple substitution of the R groups listed above (including when they form fused benzene rings), as with halogen atoms or ether linkages, is of course contemplated in the practice of the present invention. Where an R group is represented or suggested as an alkyl "group" as opposed to alkyl or alkyl radical, substituion is contemplated and included in the recitation of that group.

The heterocyclic additives of the present invention should be present in a molar ratio of from 0.1/1 to 20/1 with regards to silver halide present in the photothermographic system. A preferred ratio is from 0.5 to 5 moles of heterocyclic additive per mole of silver halide in the photothermographic system, with an approximately 1 to 1 ratio being the most preferred.

Photothermographic systems having silver halide and silver source material therein generally contain from 0.25 to 15 molar percent silver halide present in the total of silver compounds present in the system. It is preferred that from 0.5 to 8 percent of the silver present is in the form of silver halide and most preferred that 0.75 to 50% of the silver present in the system is silver halide.

The sructures, additives, and processes useful with conventional silver organic salt and silver salt complex photothermographic materials are useful with the technology of this invention. For example, toning agents and reducing agents disclosed in U.S. Pat. Nos. 3,392,020; 3,446,648; 3,667,958; 3,667,959; 3,672,904; 3,679,426; 3,751,249; 3,751,252; 3,751,255; 3,801,321 and British Pat. Nos. 1,163,187; 3,782,941 and 3,794,488 are useful in combination with the practice of the present invention. Sensitizers and sensitizing dyes as disclosed in U.S. Pat. Nos. 3,679,422; 3,666,477; 3,761,279; and 3,719,495 are also useful, as are such materials described as image amplifiers (U.S. Pat. No. 3,708,304), color couplers (U.S. Pat. No. 3,531,286), development inhibitor releasing compounds (U.S. Pat. No. 3,700,457), decolorizable light absorbers (U.S. Pat. No. 3,745,009), mercury compounds (U.S. Pat. No. 3,589,903), etc. Processes and structures described in U.S. Pat. Nos. 3,748,137; 3,761,270; 3,764,328; 3,764,329; 3,769,019; 3,589,901; 3,152,904 (U.S. Pat. No. Re 26,719); U.S. Pat. Nos. 3,607,282; 3,685,993; 3,679,414; 3,218,166; 3,756,829 3,827,889; 3,870,523; 3,881,938; 3,885,967; 3,909,271; 3,932,189; 3,935,508, 3,954,478; 3,957,493; 4,002,749; 4,003,479; 4,009,039; 4,021,249; 4,028,129; 4,030,930; 4,036,650; 4,039,334; 4,055,432; 4,076,534; 4,102,312; 4,120,722; 4,125,403; 4,128,428; 4,140,532; and 4,144,027 are also contemplated in the practice of the present invention.

Some of the classes of heterocyclic compounds which have been found to be useful in the practice of the present invention include pyridines, 2-picolines, nicotinates, 2,6-lutidines, ethylpicolinates, 4-picolines, methylisonicotinates, quinolines, pyrazines, pyridazines, and pyrimidines.

These and other characteristics of the present invention will be further disclosed in the following examples:

EXAMPLES 1-24

A standard photothermographic emulsion was prepared as described below without any heterocyclic component. When the heterocyclic component was added in these examples, it was added in approximately equimolar proportions to the silver halide in the systems with 10 minutes of stirring. It was added in the sequence described below after the addition of the $HgBr_2$ and the 10 minute dwell time for the reaction of that component into the system.

105 grams of a 13% silver behenate homogenate was mixed with 1 gram of polyvinyl butyral, and 40 grams methylethyl ketone under red light, dark room conditions. 0.2 grams of $HgBr_2$ dissolved in 5 ml of methanol were then added with stirring for 10 minutes. 16.5 grams of polyvinyl butyral were then added with 20 minutes of stirring. 1.3 ml of a sensitizing dye* was then added and mixed for 40 minutes and the solution knife coated on to polyester base at 4 mils wet thickness then dried for 4 minutes at 180° F.

* 0.26 g dye/100 g methanol, the dye being

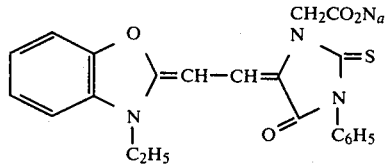

A second solution was prepared by mixing 48 grams of ethyleneglycol monomethyl ether, 40 grams acetone, 6 grams methanol, 3 grams of cellulose acetate, 2.4 grams of 2,2'-methylene-bis-(4-methyl-6-t-butylphenol), 0.34 grams phthalazine, 0.35 grams 4-methylphthalic acid, and 0.25 grams of tetrachlorophthalic anhydride. This was knife coated over the first dried solution and then dried for 3 minutes at 180° F.

All films were given a 10,000 meter-candle-second exposure to a tungesten filament light source then developed for 20 seconds at 260° F. (126° C.) Stability was measured by the change in the minimum background density (ΔDmin) after the imaged film was passed 25 times through a commercial diazo duplicating machine at approximately 160° F. (72° C.) on rollers under an approximately 400 watt ultraviolet lamp. This was recorded as $\Delta D_{min}$.

Where the example indicates that HBr was also used to halidize the emulsion, the HBr was added as 2.5 g of a 48% HBr solution (in water) and 5 ml of methanol and mixed over a 10 minute period immediately before the addition of the mercuric bromide. Where the example indicates that N-methylpyrrolidinone was added, 0.6 g of NMP was mixed into the emulsion for 10 minutes prior to halidization.

Examples 1-25

| Example | Additive | Amt (g) | Rel Spd | ΔDmin Wratten® (18A filter) |
|---|---|---|---|---|
| 1 | None | — | 1.0 | .07 |
| 2 | Comparative Ex. 1 (HBr) | — | 7.1 | .15 |

-continued

Examples 1-25

| Example | Additive | Amt (g) | Rel Spd | ΔDmin Wratten® (18A filter) |
|---|---|---|---|---|
| 3 | Comparative Ex. 2 (HBr/NMP) | — | 28.9 | .16 |
| 4 | Pyridine | .08 | 25.8 | .01 |
| 5 | Pyridine (NMP) | .08 | 53.9 | .01 |
| 6 | 2-Picoline | .09 | 15.2 | .03 |
| 7 | Ethyl nicotinate | .15 | 18.7 | .05 |
| 8 | 2,6-Lutidine | .11 | 17.0 | .04 |
| 9 | Ethyl picolinate | .15 | 18.7 | .04 |
| 10 | Methylpyrazine | .09 | 9.4 | .05 |
| 11 | Pyrazine | .08 | 11.8 | .03 |
| 12 | Quinoline | .13 | 17.0 | .04 |
| 13 | 4-Picoline | .09 | 36.4 | .08 |
| 14 | Methyl isonicotinate | .14 | 11.0 | .03 |
| 15 | Pyridazone | .08 | 23.0 | .04 |
| 16 | Pyrimidine | .08 | 6.5 | .08 |
| 17 | 2-Acetylpyridine | .12 | 0.96 | .08 |
| 18 | 3-Acetylpyridine | .12 | 13.2 | .05 |
| 19 | Quinoxaline | .13 | 1.3 | .05 |
| 20 | 2-Chloropyridine | .11 | 1.1 | .07 |
| 21 | 2-Mercaptopyridine | .11 | no image | .12 |
| 22 | 2-Hydroxypyridine | .10 | 1.0 | .10 |
| 23 | 4-Dimethylaminopyridine | .12 | 123 | .04 |
| 24 | 4-polyvinylpyridine | .15 | 1.9 | .01 |

Examples 25-31

| Ref. | Additive | Amt | Rel Spd | ΔDmin (18A Filter) |
|---|---|---|---|---|
| 25 | None | — | 2.14 | .06 |
| 26 | Pyridine | .08 | 108 | .03 |
| 27 | 2-Hydroxypyridine | .09 | v.v.slow | .04 |
| 28 | 3-Hydroxypyridine | .09 | 63 | .05 |
| 29 | 4-Cyanopyridine | .10 | 4.5 | .05 |
| 30 | Nicotinic Acid | .12 | v.v.slow | .07 |
| 31 | Pyridine* | .08 | 66.3 | .00 |

*Pyridine and $HgBr_2$ were premixed for 60 minutes in 8 ml methanol. Then mixed with the emulsion for 20 minutes after the pre-halide resin addition.

Examples 25-31 used a different sensitizing dye having the formula

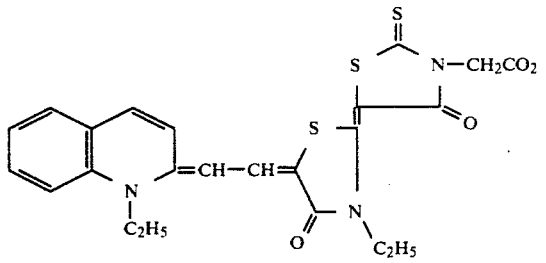

as 2.6 ml of a mixture of 0.26 g in 100 ml of methanol. The emulsions were mixed and coated under green light, dark room conditions.

EXAMPLES 32-34

These examples are intended to show the usefulness of the additives of the present invention in preformed silver halide systems.

An homogenate was formed by first adding 80 grams of behenic acid to 2 liters of water at 80° C. with stirring. 5 ml of concentrated nitric acid was then added. A silver bromide emulsion in gelatin (30% by weight of grains of 0.08 micron per side) was slowly added under red light, dark room conditions and followed by the addition of 9.3 g sodium hydroxide in 500 ml of water over a 30 minute period. The mixture was then cooled to 55° C. and 39.5 grams of silver nitrate in 400 ml $H_2O$ was added with continuous stirring. This mixture was then heated to 70° C. for 1.5 hours. This mixture was then filtered and washed twice with 2 liters of water. The solid was collected and dried for two days at 33° C., resulting in 96 grams of pale yellow powder. This was mixed with 760 grams of methylethyl ketone and 333 grams of toluene and then passed twice through a homogenizer to produce the preformed silver homogenate.

A first coating solution was prepared by mixing 100 grams of preformed silver homogenate with 1.5 grams of polyvinyl butyral (with 5 minutes of mixing), 0.24 grams of tetrachlorophthalic anhydride in 6 ml of 50:50 acetone/methanol (with 5 minutes stirring), 0.10 grams of mercury bromide in 2 ml methanol (with 5 minutes stirring), 10 grams of polyvinyl butyral (with 20 minutes stirring), and 1.31 ml of the dye solution of Example 1 (with 40 minutes stirring). Where pyridine was added in the examples below, it was added after the addition of mercuric bromide and stirred for 10 minutes. This was coated and dried on polyester base as in Example 1. A topcoat having the same composition as that of Example 1 was coated and dried as in Example 1. The results are shown in the following table.

| Example | Pyridine (g) | Relative Speed | Stability (2)ΔDmin |
|---|---|---|---|
| 33 | 0 | 37.3 | 0.08 |
| 34 | 0.08 | 74.4 | 0.07 |
| 35 | 0.40 | 53.9 | 0.05 |

EXAMPLES 36-43

The following examples show that the advantages of the addition of compounds according to the present invention are independent of the nature of the halide source in the photothermographic emulsion.

The noted halide salts were added to the emulsion of Example 1 in place of the mercuric bromide. The salts in the weight indicated, were dissolved in 8 ml of methanol prior to addition. After halidization, 0.18 g of mercuric acetate in 5 ml. of methanol was added immediately before addition of the sensitizing dye. The results are shown below.

| Example | Halide | Grams | Pyridine (grams) | Rel. Spd. | $\Delta D_{min}$ |
|---|---|---|---|---|---|
| 36 | Nickel Bromide | 0.15 | — | 4.2 | 0.04 |
| 37 | Nickel Bromide | 0.15 | 0.1 | 10.7 | 0.03 |
| 38 | Zinc Bromide | 0.12 | — | 10.0 | 0.04 |
| 39 | Zinc Bromide | 0.12 | 0.1 | 8.7 | 0.02 |
| 40 | Calcium Bromide | 0.11 | — | 3.1 | 0.02 |
| 41 | Calcium Bromide | 0.11 | 0.1 | 4.5 | 0.03 |
| 42 | Hydrogen Bromide | 0.17 | — | 9.2 | 0.06 |
| 43 | Hydrogen Bromide | 0.17 | 0.1 | 20.5 | 0.04 |

We claim:

1. An unimaged photothermographic system having at least one emulsion layer comprising an image-silver source material of organic silver salts or complexed silver salts where the coordinating compound has a gross stability constant of between 4.50 and 10.0 with silver ion, silver halide in catalytic proximity to the image-silver source material, and a reducing agent for silver ion, where said system is characterized by having from 0.1/1 to 20/1 molar ratio to the silver halide in said emulsion of a heterocyclic compound selected from the group consisting of pyridines, 2-picolines, nicotinates, isonicotinates, 2,6-lutidenes, 4-picolines, quinolines, pyrazines, pyridazines, and pyrimidines.

2. The photothermographic system of claims 1 wherein each heterocyclic compounds are selected from the group of the formulae:

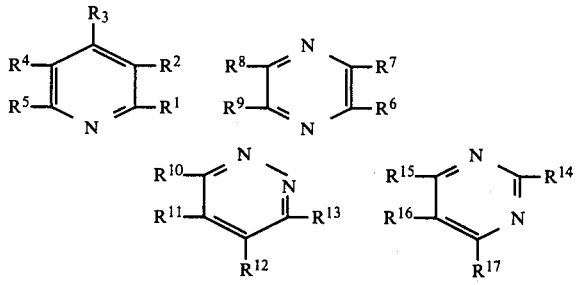

wherein $R^1$, $R^3$. $R^5$, $R^6$, $R^7$, $R^8$, $R^9$, $R^{10}$, $R^{13}$, $R^{14}$, $R^{15}$ and $R^{17}$ are selected from the group consisting of hydrogen, alkyl group of 1 to 20 carbon atoms, alkoxy group of 1 to 12 carbon atoms, carboalkoxy group of 2 to 13 carbon atoms, wherein $R^3$, $R^{11}$, $R^{12}$ and $R^{16}$ may also be selected from the group consisting of acyl of 1 to 12 carbon atoms;

wherein $R^2$, $R^4$, $R^{12}$, and $R^{16}$ are selected from the group consisting of hydrogen, alkyl group of 1 to 20 carbon atoms, alkoxy group of 1 to 12 carbon atoms, carboalkoxy group of 2 to 13 carbon atoms, acyl of 1 to 12 carbon atoms, and hydroxy, and wherein $R^1$ and $R^2$, $R^2$ and $R^3$, $R^6$ and $R^7$, $R^{10}$ and $R^{11}$, $R^{15}$ and $R^{16}$, and $R^{16}$ and $R^{17}$ may represent the carbon and hydrogen atoms necessary to form a fused benzene ring group sharing a common ethylene group with the heterocyclic rings of the formula.

3. The photothermographic system of claim 2 wherein said image-silver source material is a silver salt of an organic acid having from 12 to 30 carbon atoms.

4. The photothermographic emulsion of claim 2 wherein said silver halide is formed by in situ halidization of said image-silver source material.

5. The photothermographic emulsion of claim 2 wherein said silver halide is preformed or coprecipitated with said image-silver source material.

6. The photothermographic emulsion of claim 2 wherein said reducing agent for silver ion is a hindered phenol developer.

7. The photothermographic emulsion of claims 3, 4, 5 and 6 wherein said heterocyclic compound is pyridine.

8. The photothermographic emulsion of claim 3 wherein said heterocyclic compound is present in a molar ratio of from 0.1/1 to 20/1 with regard to the silver halide present.

9. The photothermographic emulsion of claims 4, 5, or 8 wherein said image-silver source material comprises silver behenate, said silver halide is present in an amount equal to between 0.25 to 15 molar percent of all silver compounds in the emulsion, and said heterocyclic compound is selected from the class consisting of pyridine, 3-hydroxypyridine, and 4-dimethylaminopyridine.

10. The photothermographic emulsion of claim 8 wherein said emulsion also contains an effective amount of N-methylpyrolidinone.

* * * * *